US005744050A

United States Patent [19]

Shaw

[11] Patent Number: 5,744,050

[45] Date of Patent: Apr. 28, 1998

[54] NOZZLE

[76] Inventor: Richard Dudley Shaw, Dunedin, High Elms Road, Downe, United Kingdom, BR6 7JN

[21] Appl. No.: 736,084

[22] Filed: Oct. 24, 1996

[30] Foreign Application Priority Data

Oct. 31, 1995 [GB] United Kingdom ..... 9522217

[51] Int. Cl.[6] ..... B22D 41/58

[52] U.S. Cl. ..... 222/603; 266/220

[58] Field of Search ..... 266/220, 265; 222/591, 603, 594

[56] References Cited

U.S. PATENT DOCUMENTS

| | | | |
|---|---|---|---|
| 4,923,225 | 5/1990 | Luhrsen et al. | 222/603 |
| 5,100,035 | 3/1992 | Dunworth et al. | 222/603 |
| 5,137,189 | 8/1992 | Hall et al. | 222/603 |

FOREIGN PATENT DOCUMENTS

| | | | |
|---|---|---|---|
| A-509699 | 10/1992 | European Pat. Off. . | |
| 404274864 | 9/1992 | Japan | 222/603 |
| A-2148765 | 6/1985 | United Kingdom . | |

*Primary Examiner*—Scott Kastler
*Attorney, Agent, or Firm*—Nixon & Vanderhye

[57] ABSTRACT

The present invention provides a nozzle for teeming molten metal, particularly molten steel, from a tundish or other receptacle, which nozzle comprises an inlet, an outlet, and inner and outer tubular members which define a bore through the nozzle between the inlet and outlet. The nozzle is characterised in that both of said inner and outer tubular members are constructed from refractory materials, and in that the inner member extends within the outer member to the inlet. The inner and outer ceramic layers thus form a "double-layer" of refractory material up to the extremity of the nozzle at the inlet end.

10 Claims, 3 Drawing Sheets

NOZZLE

FIELD OF THE INVENTION

The present invention relates to a nozzle for teeming molten steel from a tundish or other suitable receptacle.

BACKGROUND OF THE INVENTION

Nozzles for teeming molten steel generally comprise a ceramic lining which defines a bore for the passage of the molten steel therethrough. Naturally, ceramic is chosen in view of its refractory properties. It is known from the prior art however that a problem with such nozzles is that under the extreme operating conditions which exist when teeming molten metal from a tundish, the refractory material is susceptible to attack from non-ferrous constituents of the steel, particularly aluminium. These elements which are present in molten steel readily combine with oxygen at the temperature of molten steel to form oxides which collect and build-up in the nozzle leading ultimately to blockage of the bore. Oxidation of these reactive particles is exacerbated by the substantial aspiration of air into the nozzle which arises as a result of the vacuum generated by the molten steel as it enters into and flows down through the nozzle. U.S. Pat. No. 5,100,035 discloses an immersion nozzle for continuous metal casting which comprises a porous ceramic lining which is encased in a metal housing. The nozzle comprises a port for the admission of nascent gas into the body of the nozzle, and a plurality of axially and circumferentially oriented distribution channels are formed in the ceramic lining for distributing the gas through the nozzle. In use, gas admitted to the nozzle through the port is distributed through the channels into the porous ceramic material from where it can debouch into the bore to form a thin boundary layer between the surface of the ceramic lining and the molten metal. This has the effect of protecting the refractory from attack or build up of non-ferrous particles within the molten metal, and also "lubricates" the inner lining of the nozzle. In addition, the flow of nascent gas into the nozzle bore excludes air from the nozzle and diminishes the magnitude of the vacuum generated by the flow of metal through the nozzle.

A disadvantage of the immersion nozzle disclosed by U.S. Pat. No. 5,100,035 is that under the extreme conditions of use, the outer metal housing is substantially weakened. Furthermore, during operation, small cracks will almost always appear in the ceramic lining. The interface between the ceramic lining and metallic housing also constitutes a line of weakness. It has been found that as a result of these factors in use the nozzle of U.S. Pat. No. 5,100,035 allows molten metal to penetrate into the joint between the ceramic and metal housing. Furthermore, in the event that the ceramic cracks catastrophically, the metallic casing will not contain the molten metal, and "breakout"will occur.

A different nozzle which is commercially available from Clinochem is shown in accompanying FIG. 1. This nozzle comprises inner and outer tubular members (1, 2) which are both made from refractory. The outer member (2) is cast onto the inner member (1) which is pre-formed. In the finished nozzle, as will be seen in FIG. 1, the inner member (1) is located in a rebate formed in the outer member, which rebate is spaced from the inlet to the nozzle. Said inlet includes a bell-shaped mouth portion (3) defined by the outer member (2). A small clearance is provided between the inner and outer members (1, 2) at the shoulder of the rebate to form an annular slot (7). Said slot (7) communicates with a gas port (4) via a plurality of axially-oriented passages (6) and annular distribution rings (5, 8) formed in the interface between the inner and outer members (1, 2). In service, nascent gas inletted to the nozzle via the port (4) is distributed via the rings (5, 8) and passages (6) to the slot (7) where it debouches into the bore of the nozzle to lubricate and protect the ceramic lining the manner described above.

It is an object of the present invention to provide an improved nozzle for teeming molten metal from a tundish or similar receptacle. In particular, it is an object of the invention to provide a nozzle for molten metal which provides greater flexibility to points or areas of gas introduction but at the same time retaining the proven safety features of the known Clinochem design.

SUMMARY OF THE INVENTION

Accordingly, in one aspect of the present invention there is provided a nozzle for teeming molten metal, particularly molten steel, from a tundish or other receptacle, which nozzle comprises an inlet, an outlet, and inner and outer tubular members which define a bore through the nozzle between the inlet and outlet; characterised in that both of said inner and outer tubular members are constructed from refractory material, and in that the inner member extends within the outer member to the inlet.

The nozzle of the present invention thus has the advantage that it provides a "double layer" of refractory material up to the extremity of the nozzle at the inlet end. Thus, if the inner ceramic member fails, molten metal within the nozzle will be contained by the outer member until the nozzle can be replaced.

Preferably the inner refractory member also extends to the other extremity of the nozzle at the outlet end. In this case, it will be understood that the bore of the nozzle will be defined wholly by the inner member. The molten metal will not come into contact with the outer member at all unless the inner member fails.

In some embodiments, the inner member may be porous. Usually, the outer member will be substantially less porous than the inner member, or substantially non-porous.

Said nozzle may further comprise a port for admitting gas into the nozzle and a network of gas conduits formed in the inner or outer member for distributing the gas around the joint between the inner and outer members. Where the inner member is porous, the gas will permeate through the interstitial sites in the ceramic material to the bore of the nozzle. In any case, a proportion of the gas will debouch the nozzle from the joint between the inner and outer members at the inlet end of the nozzle. This has the advantage that in use, gas will be outletted from the nozzle at a location upstream of the point of maximum vacuum generated by the flow of molten metal through the nozzle.

Where the inner member is porous, the porosity may be non-uniform along the axial direction of the nozzle with the porosity being greatest in regions which are most susceptible attack. Circumferential gas distribution channels may be provided in these regions.

The surface of the bore may be cylindrical between the inlet and outlet. Alternatively, the inlet may be shaped to provide a funnel, which funnel may be bell-shaped.

Following is a description by way of example only with reference to the accompanying drawings of methods of carrying the present invention into effect.

DETAILED DESCRIPTION OF THE DRAWINGS

Figure 1:
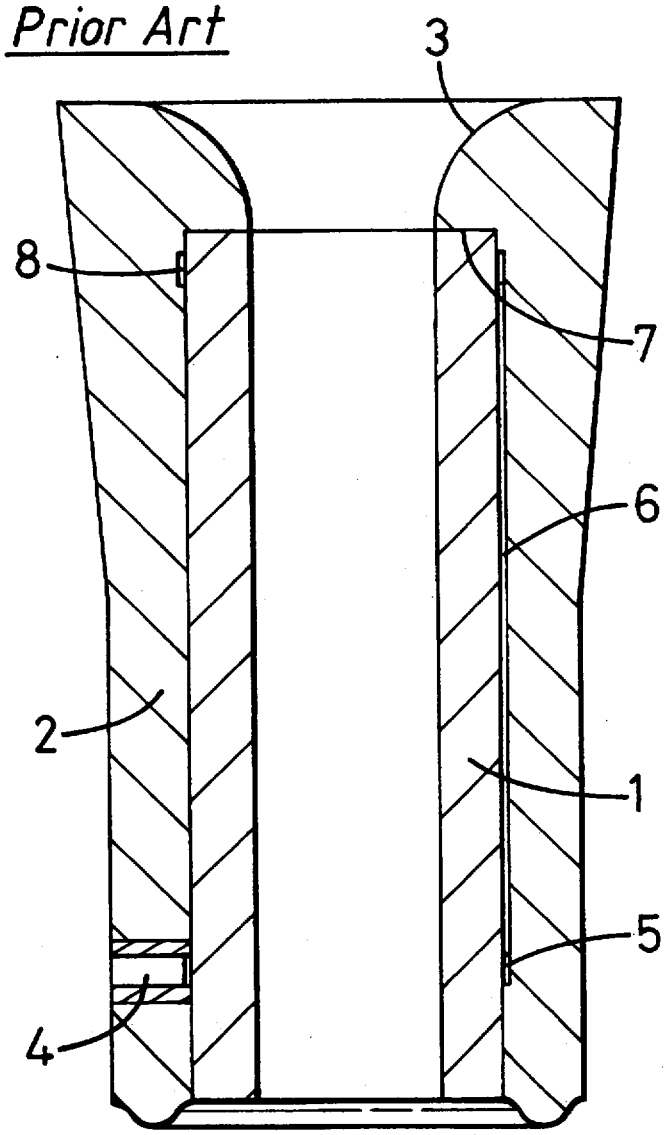
FIG. 1 Prior Art
FIG. 1 is a sectional view through the known Clinochem Ltd nozzle referred to above.
Figure 2:
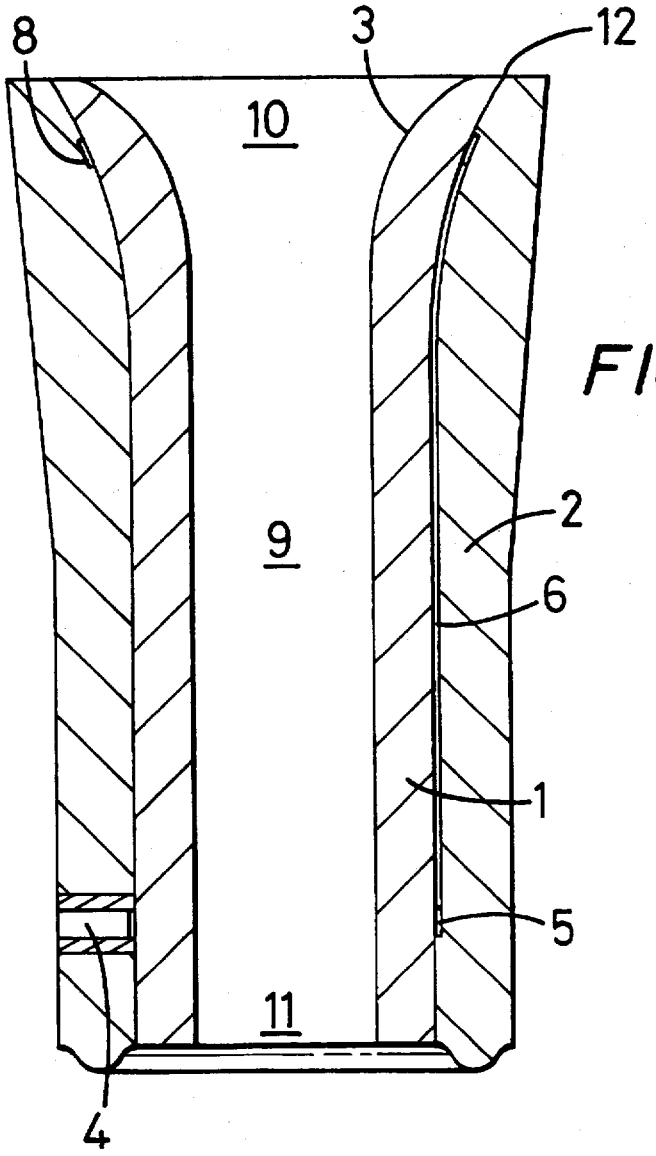
FIG. 2 is a sectional view through a nozzle in accordance with the present invention.

The nozzle shown in FIG. 2 comprises tubular inner and outer members (1,2) which are both formed from refractory materials. Said inner member (1) defines a bore (9) having an inlet (10) and an outlet (11). In the region of the inlet (10), the inner member (1) is shaped to provide a bell-shaped mouth (3).

The outer member (2) is cast from ceramic onto the inner member (1) which is preformed by casting or isopressing. As will be seen from FIG. 2, the outer member (2) is substantially coterminous with the inner member (1) at the inlet and outlet ends of the nozzle.

Juxtaposed the outlet (11), the outer member (2) is equipped with a gas port (4) which communicates with an annular channel (5) formed circumferentially in the inner or outer member (1,2) along the interface between the two members. In turn, this annular channel (5) communicates with a plurality of axially oriented channels (6) which extend towards the inlet end of the nozzle where they communicate with a second annular channel (8).

Said port (4) is adapted for connection to a supply of nascent gas under pressure, and in use gas supplied to the port (4) will be distributed throughout the nozzle via the annular and axially-oriented channels (5,6,8). A sizable proportion the nascent gas will debouch from the nozzle through the joint (12) between the inner and outer member (1,2) at the inlet end of the nozzle.

As mentioned above, the inner member (1) of the nozzle may be formed from a porous ceramic material. In particular, the inner member (1) may be manufactured from magnesia or magnesia aluminium spinel.

Alternatively, zirconia, zirconia spinel, zirconia magnesite, magnesium zirconate or calcium zirconate may be employed. These latter materials may be selected for their known resistance to molten steel attack or alumina reaction.

Said inner member (1) can be rendered porous in several ways which will be known to a person skilled in the art from the prior art. A preferred method of this invention is to use a phosphate-bonded castable typically as described in EP-A-0501662 with the addition of polypropylene fibres, typically 10 mm long and 25 microns in diameter at an addition of 0.05% weight. Reference is also made here to GB-A-2294232. After casting, the organic fibres can be burned off leaving voids to render the material porous. In addition, by using this phosphate technique, a good bond between the inner and outer members (1,2) will be made when casting the outer member onto the pre-formed inner member.

Said outer member may be formed from the same material as the inner member or from a different material. In particular, the outer member (2) may be made from reinforced alumina or bauxite or even cement castable of high strength, but not compatible chemically with the steel flowing through the nozzle. So long as the two tubes are compatible with each other during heat-up and in use, the properties may be substantially different. As the outer member (2) does not contact the molten metal, the outer member (2) can be made of substantially cheaper refractory or ceramic than the inner member. Said outer member (2) may include steel fibre reinforcement.

Thus, nascent gas admitted to the nozzle via port (4) and distributed along the joint between the inner and outer members (1,2) will also permeate through the interstitial spaces in the porous inner member (1) into the bore of the nozzle. Typically, nascent gas may be supplied to the port at about 6 l/min with a back pressure of about 0.25 bar.

In service, gas debouching the nozzle through the pores in the inner member (1) and the joint (12) between the inner and outer members will serve to lubricate the passage of molten steel through the bore (9), and will protect the surface of the inner ceramic member (1) from attack. The nascent gas will serve to exclude air from the nozzle and will counteract the vacuum-inducing effect of the fluid flow of molten metal into the nozzle. In this connection, it is advantageous that the gas emerging from the joint (12) between the inner and outer members (1,2) at the inlet end of the nozzle is outletted above the point of maximum vacuum within the nozzle.

The porosity or permeability of the inner member (1) can be chosen to encourage gas flow or gas restriction to suit the specific requirements. For example, if the majority or all of the gas is required to flow at the bell-shaped mouth (3) of the nozzle, then the inner member (1) can be made porous at the inlet end and substantially non-porous juxtaposed the outlet. Similarly, further annular or axial gas channels can be provided to supply nascent gas to preferred parts of the inner member (1). For example the nozzle shown in FIG. 3 includes two circumferential gas channels (8,8') towards the inlet end of the nozzle.

Figure 3:
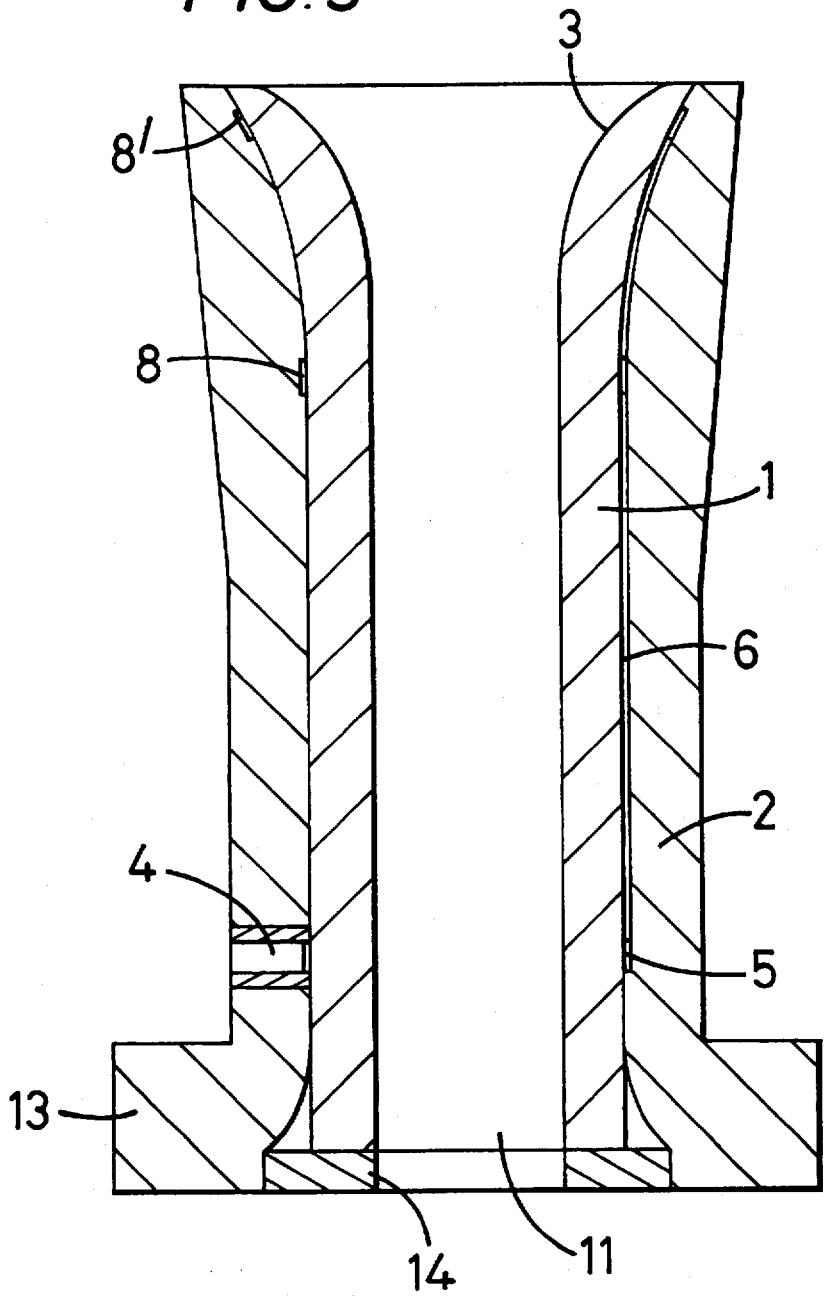
FIG. 3 is a sectional view through a different nozzle in accordance with the invention.

The embodiment shown in FIG. 3 further comprises a flange (13) which is formed integrally with the outer member (2) around the outlet of the nozzle. Said flange (13) includes a rebate which accommodates a mechanically very hard-wearing ring (14) providing a slide plate for a control valve.

Figure 4:
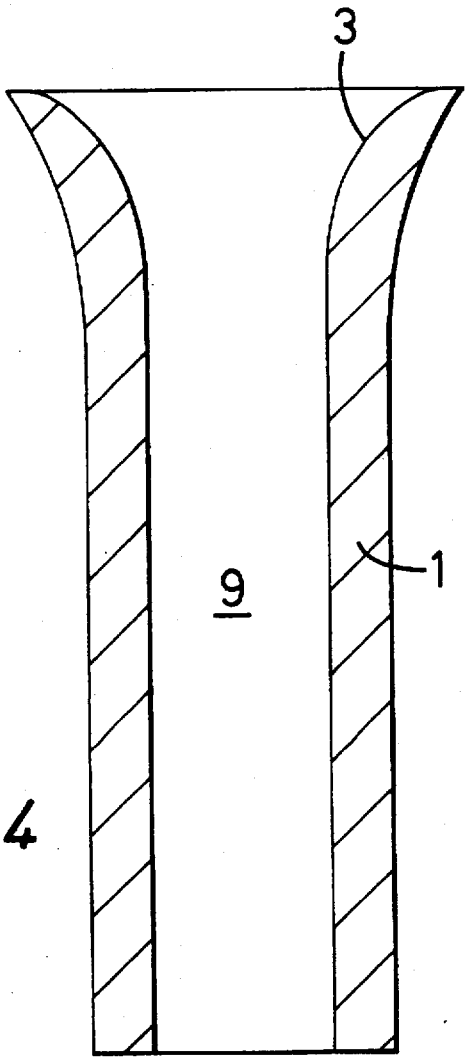
FIG. 4 shows in section an inner ceramic member for use in a nozzle in accordance with the invention.

FIG. 4 shows a preferred shape for a gas injection nozzle according to the invention. By curving the outer surface of the inner member (1) at (3), the stresses of the changing section may be minimized, and the inner member (1) firmly retained by the outer member (2). Alternatively, the bore (9) may be substantially cylindrical between the extremities at the inlet and outlet ends of the nozzle.

As an indication of size, the nozzle may have a length in the range 100 to 500 mm, an external diameter of 115 to 140 mm, and an internal diameter of 65 to 90 mm. Naturally however the precise dimensions chosen will vary according to the specific case.

The nozzles according to the present invention as hereinbefore described have the advantage that the inner and outer tubular members (1,2) effectively provide a double layer of protection against the break out of molten metal from the nozzle. The outer member is entirely shielded from the molten metal by the inner member, and by being made from ceramic has sufficient mechanical strength at operating pressure and temperature such that in the event of failure of the inner member, the molten metal will be contained by the outer member until the nozzle can be replaced.

I claim:

1. A nozzle for teeming molten metal from a tundish or other receptacle, which nozzle comprises an inlet, an outlet, an inner tubular member and an outer tubular member said outer tubular member and said inner tubular member being joined to one another forming a joint therebetween, a passageway through the nozzle between the inlet and outlet and a port for admitting gas into the nozzle between the inner and outer members; said inner and outer tubular members being constructed from refractory materials, said inlet and outlet being disposed respectively at inlet and outlet ends of the nozzle, said inner and outer tubular members extending to the inlet end of the nozzle and the joint between the inner and outer tubular members being gas-permeable.

2. A nozzle as claimed in claim 1, wherein the inner tubular member also extends to the outlet, such that the passageway of the nozzle is defined wholly by the inner tubular member.

3. A nozzle as claimed in claim 1, wherein the inner tubular member is gas-permeable.

4. A nozzle as claimed in claim 3, wherein the outer tubular member is substantially less porous than the inner tubular member, or substantially non-porous.

5. A nozzle as claimed in claim 1, further comprising a network of gas conduits formed between the inner and outer tubular members for distributing said gas around the joint between the inner and outer tubular members.

6. A nozzle as claimed in claim 1, wherein the inner tubular member is porous, and the porosity is non-uniform along the axial direction of the nozzle with the porosity being greatest in regions which are most susceptible to deposition of non-ferrous metal oxides.

7. A nozzle as claimed in claim 1, wherein said refractory materials comprise ceramics.

8. A nozzle as claimed in claim 1 including a portion of said joint at said inlet end of said nozzle, the gas-permeability of said joint portion enabling outflow of gas from the nozzle through said joint portion at said inlet end of said nozzle.

9. A nozzle according to claim 1 wherein the inner tubular member also extends to the outlet, such that the passageway of the nozzle is defined wholly by the inner tubular member, a network of gas conduits formed between the inner and outer tubular members for distributing said gas around the joint between the inner and outer tubular members.

10. A nozzle according to claim 9 including a portion of said joint at said inlet end of said nozzle, the gas-permeability of said joint portion enabling outflow of gas from the nozzle through said joint portion at said inlet end of said nozzle.

* * * * *